US006626307B1

(12) United States Patent
Lin

(10) Patent No.: US 6,626,307 B1
(45) Date of Patent: Sep. 30, 2003

(54) DETACHABLE COAT HANGER

(76) Inventor: Show-May Lin, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/223,743

(22) Filed: Aug. 20, 2002

(51) Int. Cl.[7] ..... A47B 47/00
(52) U.S. Cl. ..... 211/206
(58) Field of Search ..... 211/206, 182, 211/189, 204, 183

(56) References Cited

U.S. PATENT DOCUMENTS 2,557,766 A * 6/1951 Ronfeldt ..... 403/237
2,881,017 A * 4/1959 Millar, Jr. ..... 403/340
2,919,149 A * 12/1959 Farley ..... 430/126
3,620,377 A * 11/1971 Holtz ..... 211/206
5,743,412 A * 4/1998 Noble ..... 211/59.2

* cited by examiner

*Primary Examiner*—Alvin Chin-Shue
*Assistant Examiner*—Sarah Purol

(57) ABSTRACT

A detachable coat hanger comprises a stand rod and a transversal rod. A lower end of the stand rod is welded with an upper support plate. The upper support plate has a cambered shape matched to a radial surface of the transversal rod. A middle section of the upper support plate is formed with a first threaded hole which is communicated to the stand rod. A lower support plate has a second threaded hole and has a shape matched to one radial surface of the transversal rod. A stud penetrates through the threaded hole of the lower support plate, the screw hole of the transversal rod, threaded hole of the upper support plate to the threaded groove to firmly fix the transversal rod between the upper support plate and the lower support plate. Thereby, it can resist a large outer force without deformation.

1 Claim, 5 Drawing Sheets

DETACHABLE COAT HANGER

BACKGROUND OF THE INVENTION

The present invention relates to coat hangers, and particularly to a detachable coat hanger.

Referring to FIG. 1, the prior art coat hanger includes a transversal suspending rod 4. The coat hanger has a stand rod 2 a lower section of which is installed with a transversal rod 3 and a support rod 5.

To be transferred easily and reduce the volume thereof, the elements of the hanger are detachably connected, while the stand rod 2 and the transversal rod 3 are connected by welding. However, this will have a large volume so that the transfer work is affected. Moreover, if the hanger is collided or broken, this will induce that the stand rod 2 and transversal rod 3 deform and can not be repaired or updated easily. Therefore, this prior art design is not practical.

Referring to FIGS. 2 and 2A, a penetrating screw hole 31 is formed at a middle section of the transversal rod 3 so that a stud 6 can lock into a threaded groove 7 at a middle lower end of the stand rod 2. Thereby, the stand rod 2 will press downwards so that the lower cambered part thereof resists against the top of the transversal rod 3. This detachable structure has a combining surface only at a lower end of the stand rod 2 which is approximately equal to the cambered coverage on the periphery of the rod. The stud 6 tightly locks the two rods along a vertical direction. The whole strength for suffering from the whole force from the suspending coats is finite. Thereby, this structure is weaker than above said prior art one. Moreover, the times of repairing and updating will be increased and thus the utility of the prior art coat hanger is low.

SUMMARY OF THE INVENTION

Accordingly the primary object of the present invention is to provide a detachable coat hanger comprising a stand rod and a transversal rod. A stud passes through a screw hole at a middle section of the transversal rod from a lower side of the transversal rod so as to be combined with a threaded groove at a lower end of the stand rod. Thereby, the two rods are assembled vertically. A lower end of the stand rod is welded with an upper support plate in advance. The upper support plate has a cambered shape matched to a radial surface of the transversal rod. A middle section of the upper support plate is formed with a first threaded hole which is communicated to the stand rod. A lower support plate has a second threaded hole and has a shape matched to one radial surface of the transversal rod. A stud penetrates through the threaded hole of the lower support plate, the screw hole of the transversal rod, threaded hole of the upper support plate to the threaded groove of the stand rod so as to firmly fix the transversal rod between the upper support plate and the lower support plate. Thereby, it can resist a large outer force without deformation.

Another object of the present invention is to provide a detachable coat hanger, wherein inner concave surfaces of the upper support plate and lower support plate are formed with small ribs; when the stud locks the two rods, the ribs resists against the top and bottom of the transversal rod.

The various objects and advantages of the present invention will be more readily understood from the following detailed description when read in conjunction with the appended drawing.

BRIEF DESCRIPTION OF THE DRAWINGS

FIG. 2A, B is a partial enlarged view of FIG. 2.

FIG. 5B is a longitudinal partial enlarged view of FIG. 5.

DETAILED DESCRIPTION OF THE PREFERRED EMBODIMENT

Figure 1:
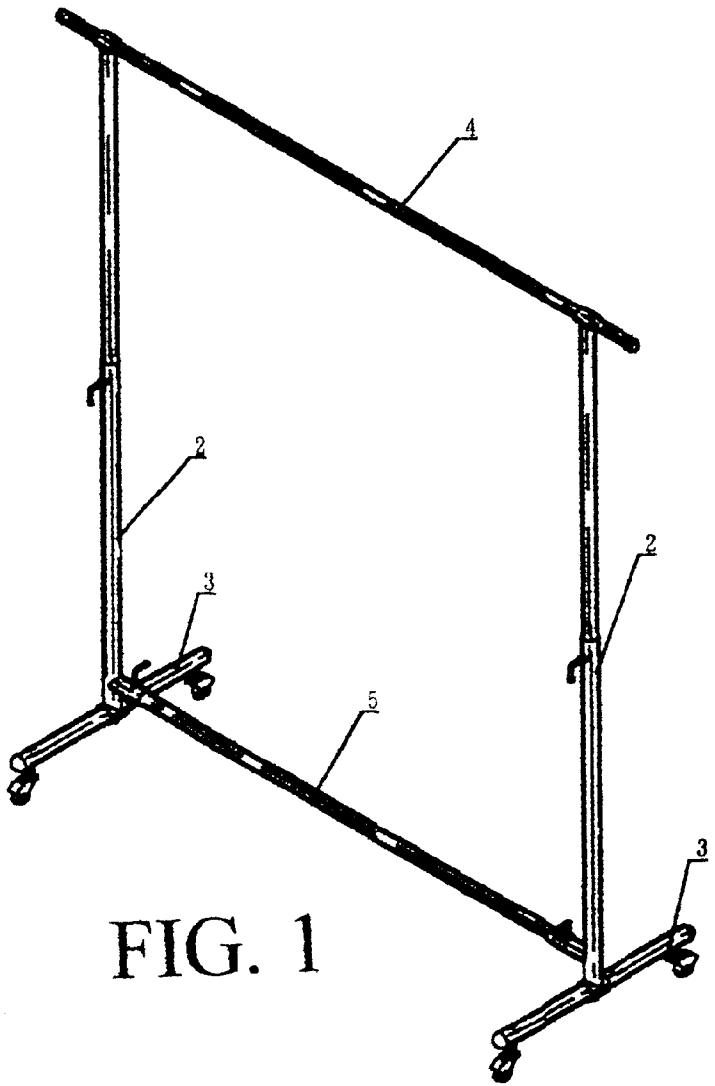
FIG. 1 is an assembled perspective view of the prior art coat hanger.
Figure 2:
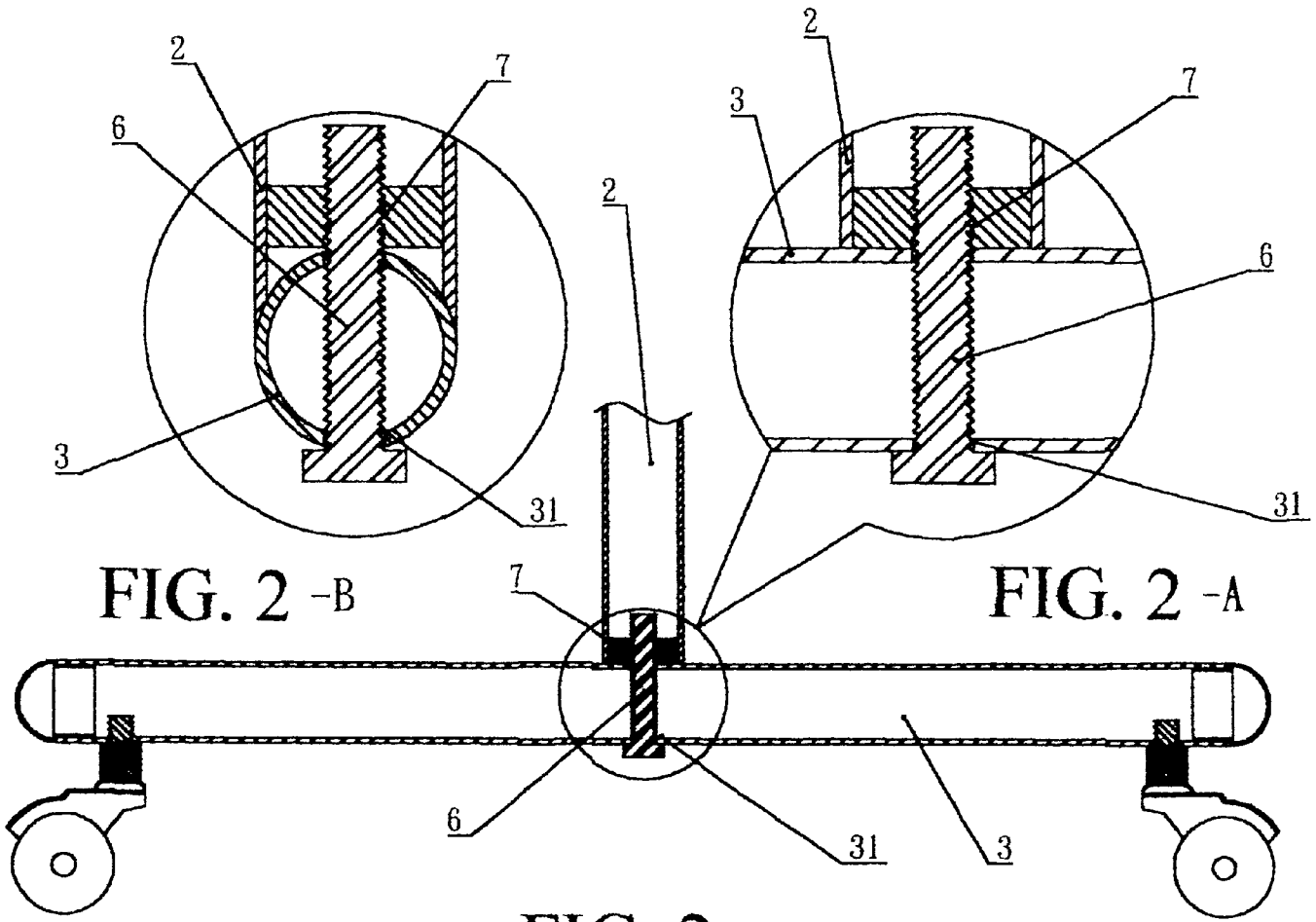
FIG. 2 PRIOR ART
FIG. 2 is a cross section view showing the prior art detachable stand rod.
Figure 3:
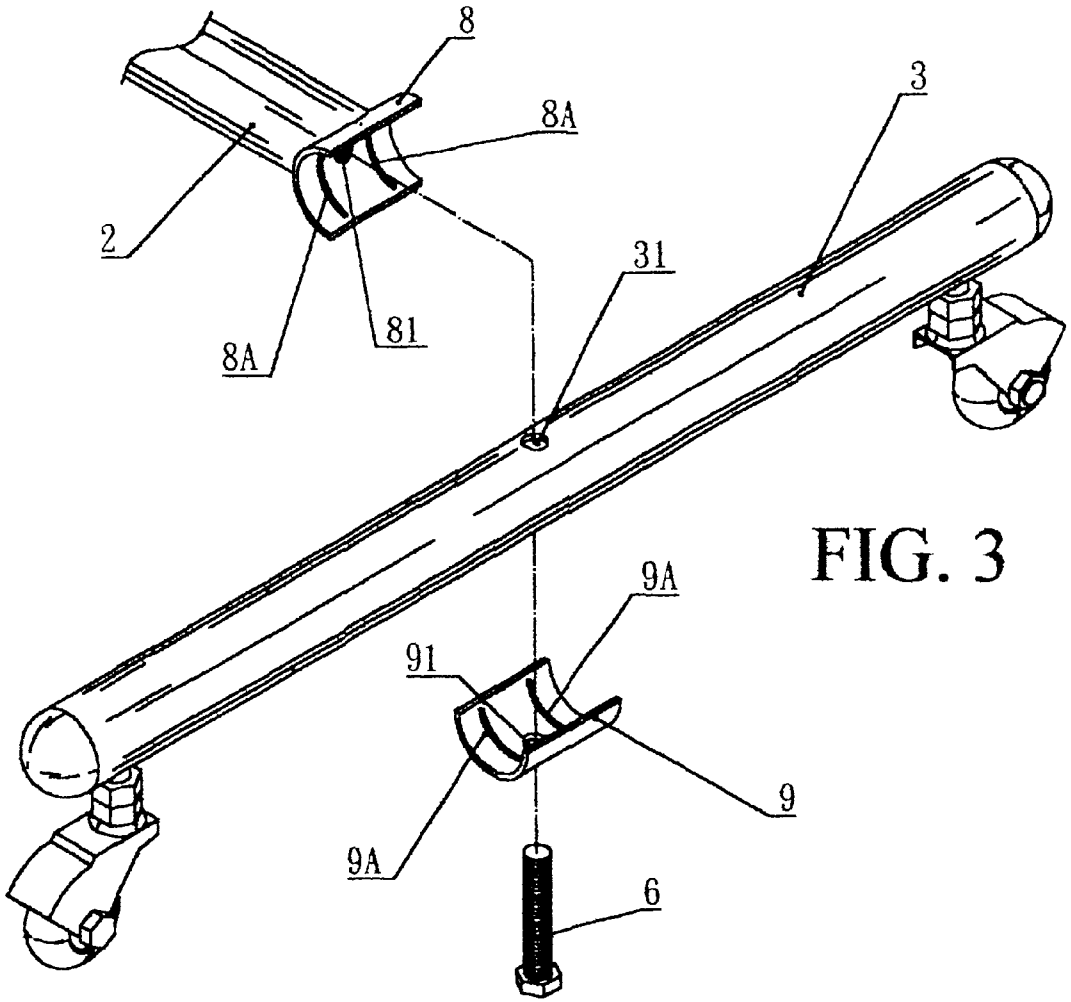
FIG. 3 is an exploded perspective view of the present invention.
Figure 4:
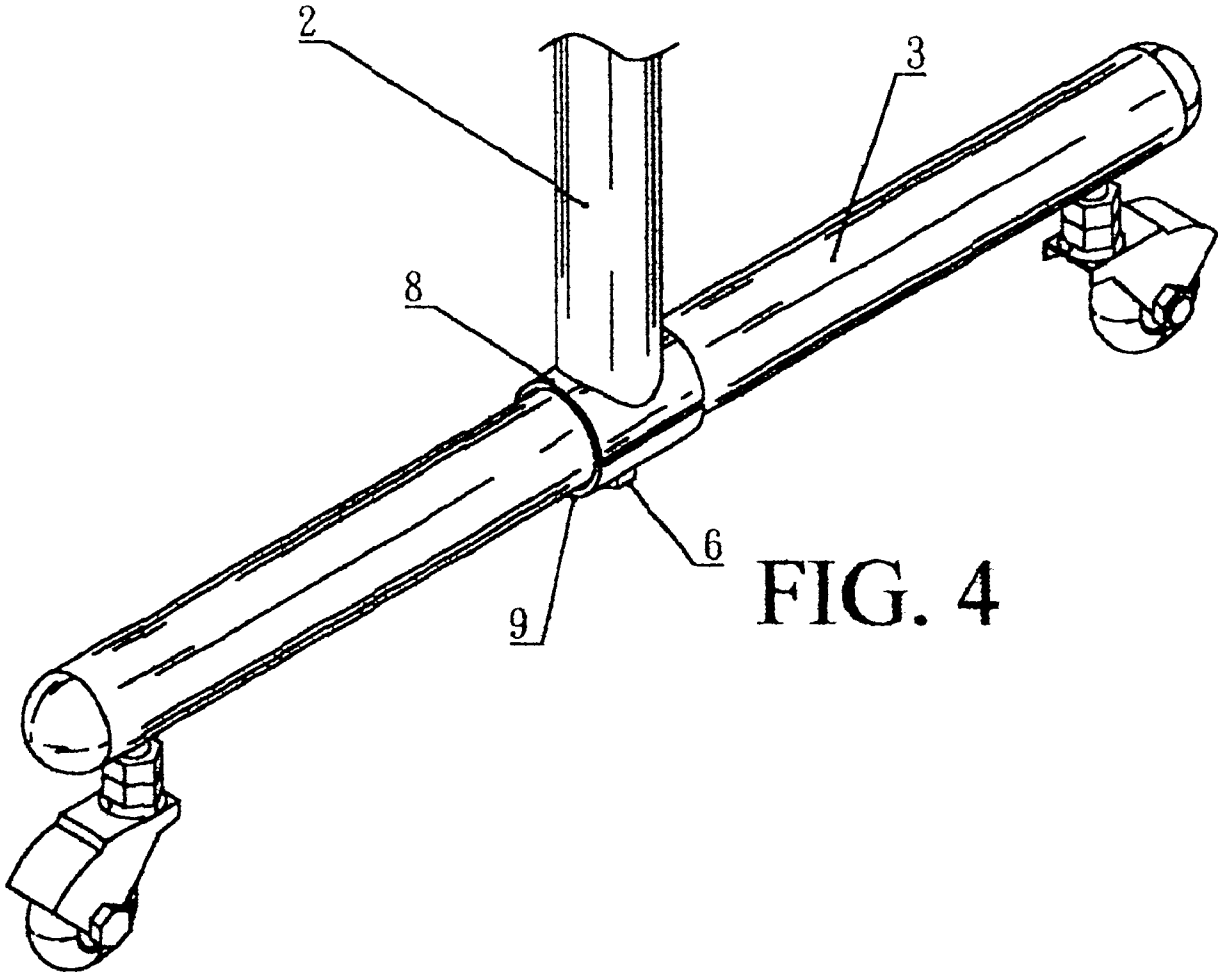
FIG. 4 is an assembled perspective view of the present invention.

The structure of the present invention will be described herein with referring to FIGS. 3 and 4. The present invention includes a stand rod 2 and a transversal rod 3. A stud 6 passes through a screw hole 31 at a middle section of the transversal rod 3 from the lower side of the transversal rod 3 so as to be combined with the threaded hole 81 at the lower end of the stand rod 2. Thereby, the two rods are assembled vertically. The feature of the present invention will be described herein.

A lower end of the stand rod 2 is welded with an upper support plate 8 in advance. The upper support plate 8 has a cambered shape matched to the radial surface of the transversal rod 3. A middle section of the upper support plate 8 is formed with a threaded hole 81 which is communicated to the stand rod 2. A lower support plate 9 has a screw hole 91 and has a shape matched to the radial surface of the transversal rod 3. A stud 6 penetrates through the screw hole 91, screw hole 31 to the threaded hole 81 so as to firmly fix the transversal rod 3 between the upper support plate 8 and the lower support plate 9. Thereby, it can resist against a large outer force without deformation (referring to FIGS. 5, 5A and 5B).

Figures 5, 5A:
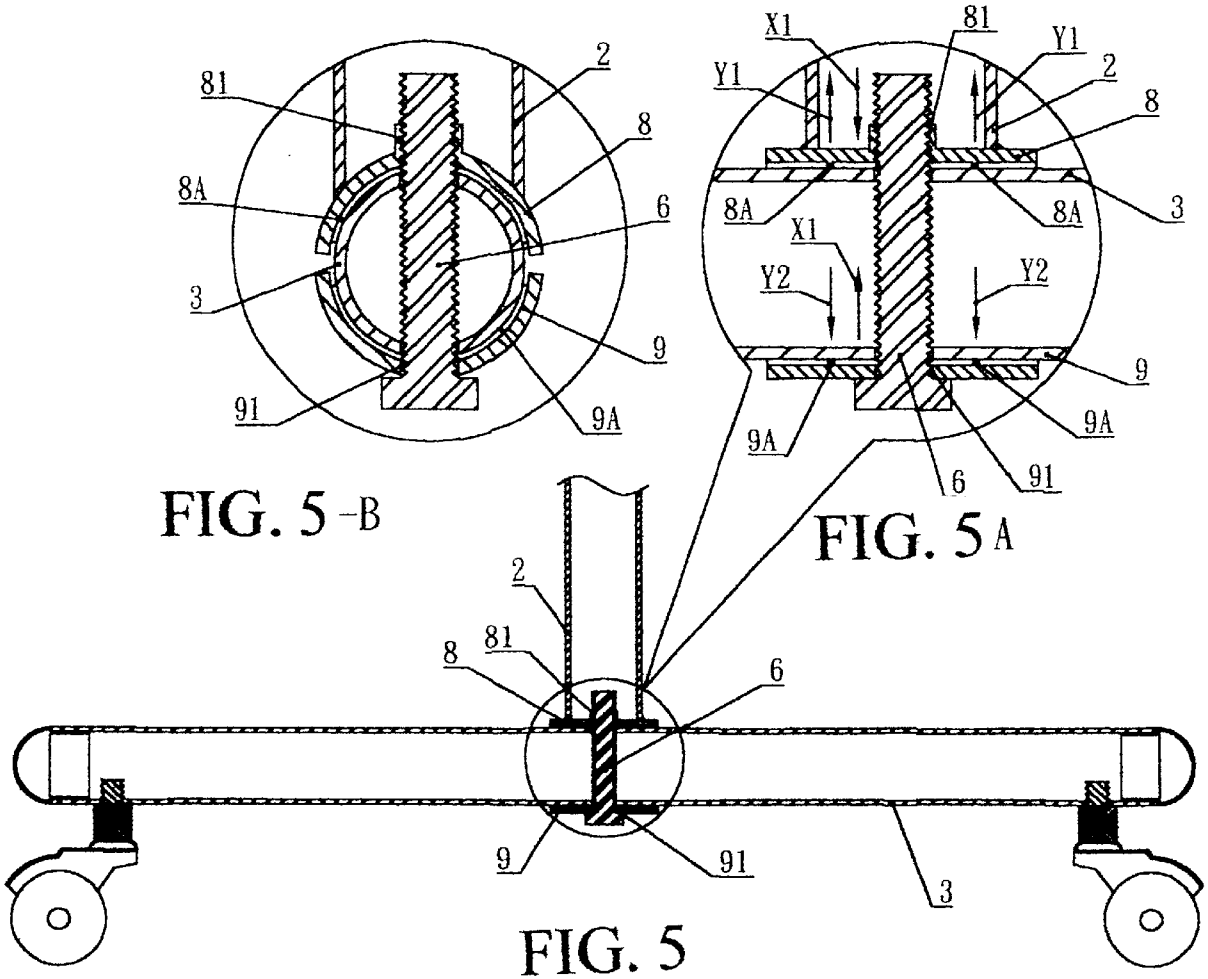
FIG. 5 is a cross section view of the detachable coat hanger in the present invention.
FIG. 5A is a transversal partial enlarged view of FIG. 5.

Referring to FIGS. 5, 5A and 5B, the concave surfaces of the upper support plate 8 and lower support plate 9 are formed with small ribs 8A and 9A. When the stud 6 locks the two rods, the ribs 8A and 9A will resist against the top and bottom of the transversal rod 3. Thereby, as illustrated in the arrows, two acting force X1, X2 acting downwards and upwards are formed and two resisting forces Y1 and Y2 are applied upon two lateral sides so as to form an optimum retaining relation. Thereby, the stud 6 is prevented from releasing and moreover, the stand rod 2 and the transversal rod 3 can be vertically combined tightly.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A detachable coat hanger comprising a stand rod and a transversal rod; a stud passing through a screw hole at a middle section of the transversal rod from a lower side of the transversal rod so as to be combined with a threaded groove at a lower end of the stand rod; thereby, the two rods being assembled vertically; characterized in that:

a lower end of the stand rod is welded with an upper support plate; the upper support plate has a cambered shape matched to a radial surface of the transversal rod;

a middle section of the upper support plate is formed with a first threaded hole which is communicated to the stand rod; a lower support plate has a second threaded hole and has a shape matched to one radial surface of the transversal rod; a stud penetrates through the second threaded hole of the lower support plate, the screw hole of the transversal rod, first threaded hole of the upper support plate to the threaded groove of the stand rod so as to firmly fix the transversal rod between the upper support plate and the lower support plate; thereby, it resists against a large outer force without deformation.

* * * * *